US007080996B2

(12) United States Patent
Østergaard

(10) Patent No.: US 7,080,996 B2
(45) Date of Patent: Jul. 25, 2006

(54) COUPLING ARRANGEMENT FOR SUBSEA ELECTRICAL POWER DISTRIBUTION

(75) Inventor: Inge Østergaard, Heggedal (NO)

(73) Assignee: Vetco Aibel AS, Billingstad (NO)

( * ) Notice: Subject to any disclaimer, the term of this patent is extended or adjusted under 35 U.S.C. 154(b) by 0 days.

(21) Appl. No.: 10/704,159

(22) Filed: Nov. 10, 2003

(65) Prior Publication Data

US 2004/0137773 A1 Jul. 15, 2004

(30) Foreign Application Priority Data

Nov. 12, 2002 (NO) ..... 2002 5425

(51) Int. Cl.
*H01R 29/00* (2006.01)

(52) U.S. Cl. ..... 439/188; 166/65.1; 439/589

(58) Field of Classification Search ..... 439/188, 439/199, 190, 589, 944; 200/51; 166/65.1
See application file for complete search history.

(56) References Cited

U.S. PATENT DOCUMENTS

| | | | | |
|---|---|---|---|---|
| 4,073,562 A | 2/1978 | Karlskind | ..... | 439/199 |
| 4,472,611 A | 9/1984 | Schoch | ..... | 200/51 R |
| 4,553,000 A | 11/1985 | Appleton | ..... | 200/50.29 |
| 5,073,125 A | 12/1991 | Hashiguchi et al. | ..... | 439/310 |
| 5,738,535 A * | 4/1998 | Cairns | ..... | 439/138 |
| 5,834,721 A | 11/1998 | Østergaard et al. | ..... | 200/81 R |

FOREIGN PATENT DOCUMENTS

| | | |
|---|---|---|
| GB | 1577850 A | 10/1980 |
| GB | 2 104 305 A | 3/1983 |

* cited by examiner

*Primary Examiner*—Michael C. Zarroli
(74) *Attorney, Agent, or Firm*—Venable LLP; Eric J. Franklin

(57) ABSTRACT

A coupling arrangement for use in subsea electrical power distribution comprising a first coupling part (1*a*), which is provided with a first contact member (3*a*) arranged in a first contact housing (2*a*) and an attachment (4*a*) for a first power conduit, and a second coupling part (1*b*), which is provided with a second contact member (3*b*) arranged in a second contact housing (2*b*) and an attachment (4*b*) for a second power conduit to be connected to the first power conduit by means of the coupling arrangement. A contact element (10) is displaceably arranged in the contact housing (2*b*) of one of the coupling parts (1*b*) so as to be displaceable towards the contact member (3*a*) of the other coupling part (1*a*), when the contact housings (2*a*, 2*b*) are secured to each other, from a first position, in which no electric connection between the contact members (3*a*, 3*b*) is established by the contact element (10), and into a second position, in which the contact element (10) is establishing electric connection between the contact members.

25 Claims, 3 Drawing Sheets

COUPLING ARRANGEMENT FOR SUBSEA ELECTRICAL POWER DISTRIBUTION

FIELD OF THE INVENTION AND PRIOR ART

The present invention relates to a coupling arrangement for use in subsea electrical power distribution and a method for connecting a first power conduit to a second power conduit by means of a coupling arrangement.

Development within offshore oil and gas exploration in the recent years has been directed to subsea installations for processing and transport of oil and gas. These subsea installations replace the traditional platforms, where oil and gas are transported up to the platform for further processing and transport. This development of subsea production, processing and transport systems has resulted in an increasing need for subsea supply of large quantities of electrical power. The salt water environment makes the subsea coupling of electrical high-voltage cables, e.g. the coupling together of two electrical high-voltage cables or the coupling of an electrical high-voltage cable to electrical equipment arranged on the sea bottom, and the maintenance of the coupling arrangements very difficult and demanding.

One type of coupling arrangement for use in subsea electrical power distribution is previously known from U.S. Pat. No. 5,834,721 A. This coupling arrangement comprises two mutually spaced contact housings mounted in a frame along a common centreline. A middle piece is removably mountable in a space between the two contact housings. At least one of the contact housings is movable along the centreline towards the middle piece so as to anchor the middle piece in a fluid-tight manner to the contact housings. The middle piece is provided with two displaceable contact elements, each of which being displaceable towards and into electrical contact with a contact member of one of the contact housings when the middle piece is in the anchored position. A flushing system is adapted to flush sea water out of the internal spaces between the middle piece and the contact housings and fill said spaces with dielectric fluid before said displacement of the contact elements. In this way, the electrical contact between the contact members does not have to be established until the different parts of the coupling arrangement have been positioned and secured in relation to each other, thereby minimizing the risk of damaging the contact members during the operation of coupling them together. Furthermore, the dielectric conditions around the contact members are improved by the flushing operation before the establishment of the electric connection between the contact members.

SUMMARY OF THE INVENTION

The object of the present invention is to provide an improved coupling arrangement for use in subsea electrical power distribution arrangements.

According to the invention, this object is achieved by a coupling arrangement that includes two main parts: the first coupling part and the second coupling part. A contact member arranged in a contact housing of the first coupling part is connectable to a contact member arranged in a contact housing of the second coupling part by means of a displaceable contact element arranged in one of the coupling parts. Consequently, no middle piece has to be inserted between the two contact housings in order to establish the electric connection between the two contact members. Furthermore, the electric connection between the two contact members is established by the displacement of only one displaceable contact element, in contrast to the coupling arrangement according to U.S. Pat. No. 5,834,721 A where the displacement of two displaceable contact elements is required.

Consequently, it is realised that the present invention offers a coupling arrangement having a simpler construction and being easier to operate, as compared to the coupling arrangement previously known from U.S. Pat. No. 5,834,721 A.

The inventive coupling arrangement could be used for coupling together two power conduits in the form of power cables. However, the inventive coupling arrangement could also be used for coupling together a first power conduit in the form of a power cable and a second power conduit constituting another type of power conduit than a power cable or coupling together two power conduits constituting other types of power conduits than power cables. One of said power conduits could for instance be an input terminal or an output terminal of an electrical appliance.

According to a preferred embodiment of the invention, the second coupling part is adapted to be mounted to the first coupling part by being lowered down vertically into engagement with the first coupling part and demounted from the first coupling part by being lifted vertically out of engagement therewith. In this way, the two coupling parts can be mounted to and demounted from each other in a very simple manner.

According to a further preferred embodiment of the invention, the second coupling part is positionable in an intermediate position in contact with the first coupling part by being lowered down vertically into engagement therewith, the second contact housing being movable in relation to the first contact housing when the second coupling part is positioned in said intermediate position so as to secure the second contact housing in a fluid-tight manner to the first contact housing. Consequently, the coupling parts are mounted to each other in a first operation and the contact housings are secured to each other in a subsequent operation. In this way, the contact housings are positioned in relation to each other before they are mutually moved and secured to each other, thereby minimizing the risk of damaging the contact housings during the operation of securing them together.

According to a further preferred embodiment of the invention, the coupling arrangement comprises a mounting tool, which is removably mountable to the second coupling part, said mounting tool being adapted to actuate the movement of the second contact housing in relation to the first contact housing so as to secure the second contact housing in a fluid-tight manner to the first contact housing. Consequently, the means for performing the operation of securing the contact housings together are at least partly accommodated in the mounting tool separate from the two coupling parts, thereby allowing a simpler, more compact and more durable construction of said coupling parts as compared to an embodiment having said means incorporated in the coupling parts.

According to a further preferred embodiment of the invention, a watertight metal seal is arranged between the contact housings so as to seal the space between the contact housings from the surrounding sea water when the contact housings have been secured to each other. It is realised that said metal seal should be of corrosion resistant metal material. Hereby, a more reliable barrier to the surrounding sea water is obtained as compared to the use of conventional elastomer seals. It has been the experience that elastomer seals have shown signs of degradation in the course of time due to ageing, which may result in loss of flexibility and cause water ingress, the latter of which may be detrimental to the dielectric property of the connector internals. This problem is eliminated by the use of metal seals.

According to a further preferred embodiment of the invention, the coupling arrangement is provided with a flushing system for flushing sea water out of the space between the first contact housing and the second contact housing and filling said space with dielectric fluid when the contact housings have been secured to each other in a fluid-tight manner. Hereby, the dielectric conditions around the contact members are improved before the establishment of the electric connection between the contact members.

According to a further preferred embodiment of the invention, a flushing device included in the flushing system and adapted to actuate the flushing out of sea water and the filling with dielectric fluid is arranged in a separate mounting tool. Consequently, means for actuating the flushing operation are accommodated in the mounting tool separate from the two coupling parts, thereby allowing a simpler, more compact and more durable construction of said coupling parts as compared to an embodiment having said means incorporated in the coupling parts.

According to a further preferred embodiment of the invention, the mounting tool accommodates the dielectric fluid to be used for said filling. Hereby, no space for storing the dielectric fluid prior to the effectuation of the flushing operation has to be provided in the coupling parts, thereby allowing a simpler and more compact construction of said coupling parts as compared to an embodiment having such a storing space provided in the coupling parts.

According to a further preferred embodiment of the invention, the contact housing accommodating the contact element is provided with a chamber, the contact element being supported by a piston, which is mounted in said chamber and which is adapted to be hydraulically actuated so as to achieve said displacement of the contact element. Hereby, the displacement of the contact element is accomplished in a simple and reliable manner.

According to a further preferred embodiment of the inventive coupling arrangement, said flushing system is adapted to control the conditioning of the dielectric properties in the space of the dielectric fluid between the first contact housing and the second contact housing. The resulting dielectric level of said conditioning is preferably verifiable through insulation resistance measurements, the acceptance of the latter being within the minimum requirements in order to commence the actual mating of the contact members.

According to a further preferred embodiment of the invention, a device adapted to control the hydraulic pressure in said chamber so as to control said displacement of the contact element is arranged in a separate mounting tool. Consequently, means for controlling the displacement of the contact element are accommodated in the mounting tool separate from the two coupling parts, thereby allowing a simpler, more compact and more durable construction of said coupling parts as compared to an embodiment having the coupling parts pre-filled with dielectric fluid, the contamination of the latter during connection, is beyond means of replacement of the dielectric fluid.

According to a further preferred embodiment of the invention, the mounting tool is adapted to be mounted to the second coupling part by being lowered down vertically into engagement therewith and demounted from the second coupling part by being lifted vertically out of engagement therewith. In this way, the mounting tool can be mounted to and demounted from the second coupling part in a very simple manner.

Further advantages as well as advantageous features of the inventive coupling arrangement will appear from the following description.

The invention also relates to a method for connecting a first power conduit to a second power conduit by means of the inventive coupling arrangement.

BRIEF DESCRIPTION OF THE DRAWINGS

With reference to the appended drawings, a specific description of preferred embodiments of the invention cited as examples follows below.

In the drawings.

DETAILED DESCRIPTION OF PREFERRED EMBODIMENTS OF THE INVENTION

FIGS. 1–4 illustrates a coupling arrangement 1 according to an embodiment of the present invention. This coupling arrangement 1 is designed for use in subsea electrical power distribution and comprises a first coupling part 1*a* and a second coupling part 1*b*, which are removably securable to each other. A first power conduit 7*a* is connected to the first coupling part 1*a* and a second power conduit 7*b* is connected to the second coupling part 1*b*. The two power conduits 7*a*, 7*b* are connectable to each other by means of the coupling arrangement 1. The respective power conduit 7*a*, 7*b* here constitutes a power cable.

Each coupling part 1*a*, 1*b* is provided with a contact housing 2*a*, 2*b* accommodating a respective contact member, not shown in FIGS. 1–4. The coupling parts 1*a*, 1*b* are so designed that a gap is provided between the contact member of the first coupling part 1*a* and the contact member of the second coupling part 1*b* when the contact housings 2*a*, 2*b* are secured to each other. A contact element, not shown in FIGS. 1–4, is displaceably arranged in the contact housing 2*a*, 2*b* of one of the coupling parts 1*a*, 1*b* so as to be displaceable towards the contact member of the other coupling part, when the contact housings 2*a*, 2*b* are secured to each other, from a first position, in which no electric connection between the contact member of the first coupling part 1*a* and the contact member of the second coupling part 1*b* is established by the contact element, and into a second position, in which the contact element is establishing electric connection between said contact members. The displacement of the contact element is preferably hydraulically actuated. A preferred embodiment of the contact members and the contact element and their mutual co-operation will be more closely described below with reference to FIGS. 5–7.

Figure 1:
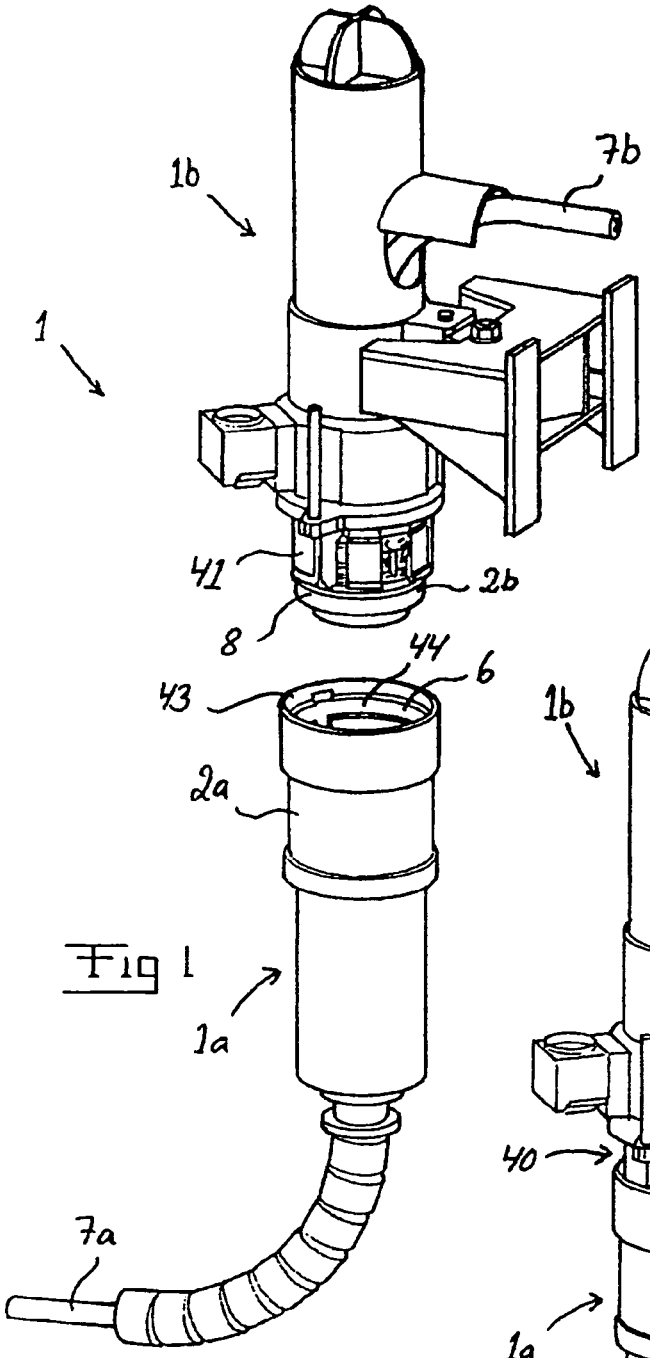
FIG. 1 is a schematical illustration of a coupling arrangement according to an embodiment of the present invention, with the two coupling parts of the coupling arrangement out of engagement with each other.

The contact housing 2*a* of the first coupling part 1*a* is preferably positioned with its centre axis vertically arranged, as illustrated in FIG. 1. The first coupling part 1*a*, which here constitutes a lower coupling part, is e.g. attached to a foundation structure, not shown, which is secured to a structure placed on the seabed. The second coupling part 1*b*, which here constitutes an upper coupling part, is part of typically an electrical drive module. The second coupling part 1*b* is in this case adapted to be mounted to the first coupling part 1*a* by being lowered down vertically into engagement with the first coupling part 1*a* and demounted from the first coupling part 1*a* by being lifted vertically out of engagement therewith. The lowering and lifting operations are e.g. carried out by means of a winch device arranged on a ship or on a platform and connected to the electrical drive module, which includes the second coupling part 1*b*, by use of a rope or wire.

In the embodiment shown in FIGS. 1–4, the contact housing 2*a* of the first coupling part 1*a* has a cavity 6 for receiving an end part 8 of the other contact housing 2*b*. Consequently, the contact housing 2*a* is designed as a female-like member and the other contact housing 2*b* as a male-like member. It is of course also possible to design the contact housing 2*a* of the first coupling part 1*a* as a male-like member and the other contact housing 2*b* as a female-like member, if so desired.

According to the illustrated embodiment, the second coupling part 1*b* is positionable in an intermediate position in contact with the first coupling part 1*a* by being lowered down vertically into engagement therewith, the contact housing 2*b* of the second coupling part 1*b* being movable in relation to the contact housing 2*a* of the first coupling part 1*a* when the second coupling part 1*b* is positioned in said intermediate position so as to secure the contact housings 2*a*, 2*b* in a fluid-tight manner to each other. For this purpose, the coupling parts 1*a*, 1*b* are provided with a locking device 40, which is adapted to support the second coupling part 1*b* in relation to the first coupling part 1*a* in said intermediate position and allow the second coupling part 1*b* to descend in relation to the first coupling part 1*a* from said intermediate position. Thereby, the contact housing 2*b* of the second coupling part 1*b* is made to descend in relation to the contact housing 2*a* of the first coupling part 1*a*. The locking device 40 is also adapted to secure the contact housings 2*a*, 2*b* to each other when the second coupling part 1*b* has been allowed to descend from the intermediate position. The locking device is preferably hydraulically actuated. In the illustrated embodiment, the locking device 40 comprises a number of pivotal locking members 41 arranged around the end part 8 of the contact housing 2*b* of the second coupling part 1*b*, which are adapted to co-operate with corresponding locking members in the form of pivot member locking surfaces 43 and grooves 42 arranged in the cavity 6 of the first coupling part 1*a*. The coupling arrangement 1 could also be provided with suitable damping devices for absorbing the impacts between the coupling parts when the second coupling part 1*b* descends in relation to the first coupling part 1*a*.

Figure 2:
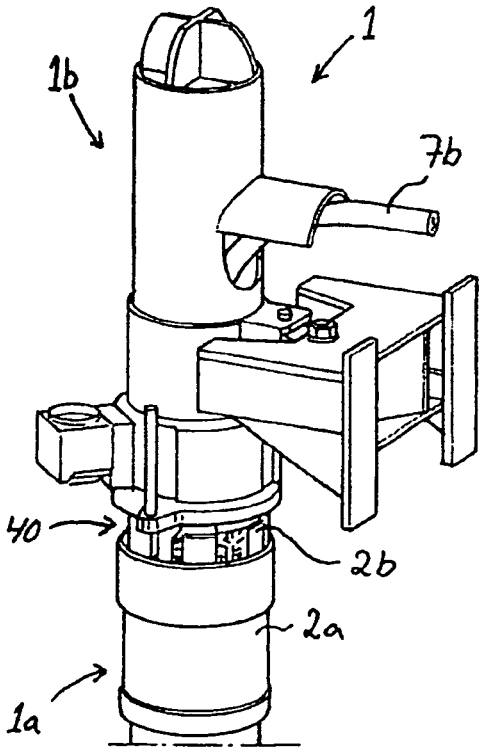
FIG. 2 is a schematical illustration of the coupling arrangement of FIG. 1, with the second coupling part in contact with the first coupling part during lowering of the former into the latter.
Figure 4:
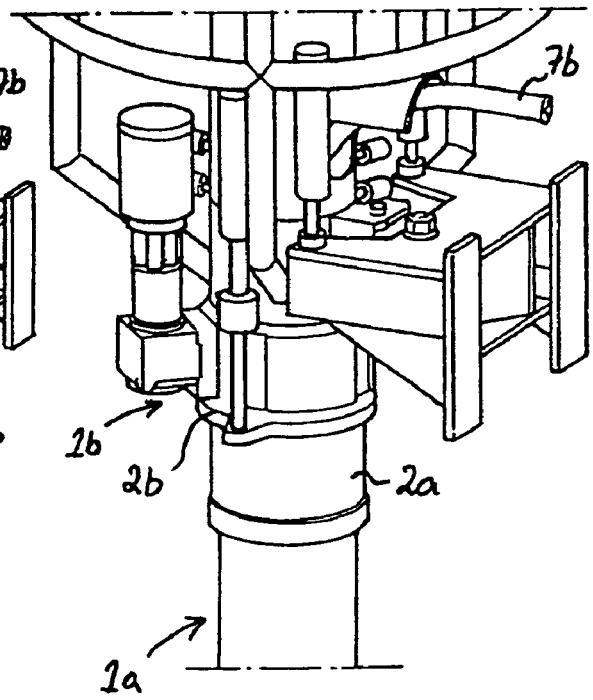
FIG. 4 is a schematical partial view of the coupling arrangement of FIGS. 1–3, illustrating the two contact housings secured to each other.

In FIG. 2, the coupling arrangement 1 is illustrated with the second coupling part 1*b* positioned in the intermediate position in contact with the first coupling part 1*a*. In this position, the second coupling part 1*b* is resting in a high, intermediate parking position by the function of a mechanical latch, not shown, through the above-mentioned locking device 40. In FIG. 4, the coupling arrangement 1 is illustrated with the two contact housings 2*a*, 2*b* secured to each other in a fluid-tight manner, i.e. after the second coupling part 1*b* has been descended in relation to the first coupling part 1*a* from the intermediate position.

The coupling arrangement preferably comprises a mounting tool 30, which is removably mountable to the second coupling part 1*b*, said mounting tool 30 being adapted to actuate the locking device 40 so as to allow the second coupling part 1*b* to descend in relation to the first coupling part 1*a* as indicated above.

Figure 3:
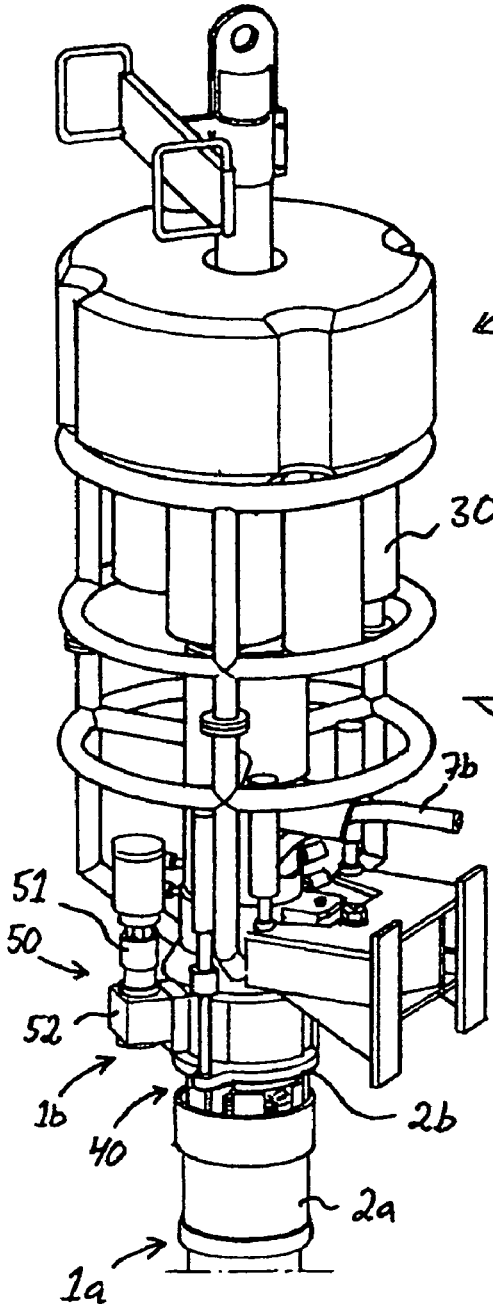
FIG. 3 is a schematical illustration of the coupling arrangement of FIGS. 1 and 2, with a mounting tool mounted to the second coupling part.

The mounting tool 30 is adapted to be mounted to the second coupling part 1*b* by being lowered down vertically into engagement therewith and demounted from the second coupling part 1*b* by being lifted vertically out of engagement therewith. The lowering and lifting operations are e.g. carried out by means of a winch device arranged on a ship or on a platform and connected to the mounting tool 30 through a rope or wire. FIG. 3 shows the coupling arrangement 1 with the mounting tool 30 mounted on top of the second coupling part 1*b*. The mounting tool 30 is hydraulically connected to the second coupling part 1*b* through a hydraulic connection 50 so as to allow a number of operations on the second coupling part 1*b* to be hydraulically actuated by the mounting tool 30. The hydraulic connection 50 comprises a connection part 51 associated with the mounting tool 30 and a corresponding connection part 52 associated with the second coupling part 1*b*. The connection part 51 associated with the mounting tool 30 is preferably moveable in relation to the remaining part of the mounting tool and adapted to be connected to the other connection part 52 by being lowered down vertically into engagement therewith after the mounting tool 30 has been brought into engagement with the second coupling part 1*b*.

Figure 5:
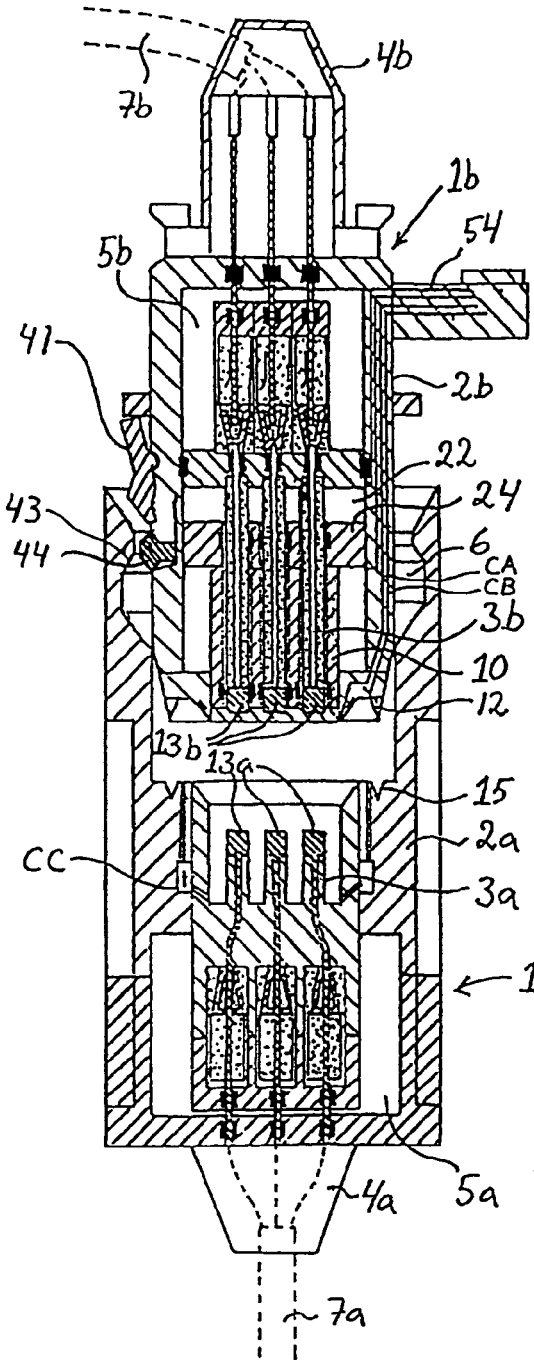
FIG. 5 is a schematical cross-sectional view illustrating a coupling arrangement according to a preferred embodiment of the invention, with the second coupling part positioned in an intermediate position in contact with the first coupling part.
Figure 6:
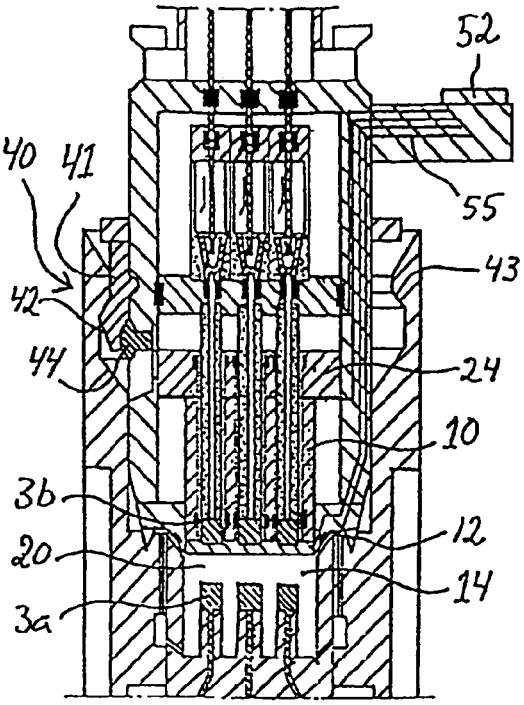
FIG. 6 is a schematical cross-sectional view illustrating the coupling arrangement of FIG. 5, with the two contact housings secured to each other.
Figure 7:
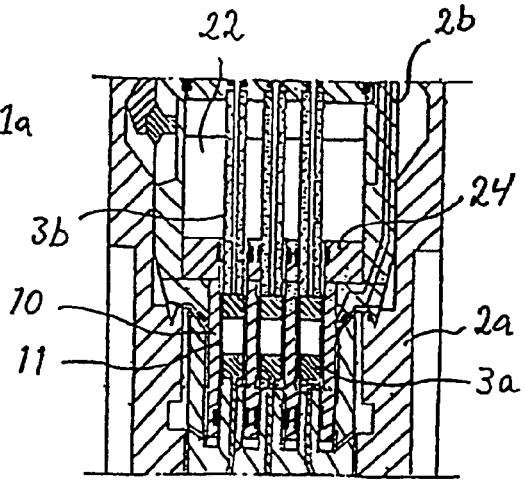
FIG. 7 is a schematical partial view illustrating the coupling arrangement of FIGS. 5 and 6 after the establishment of electric connection between the contact members of the two coupling parts.

A coupling arrangement 1 according to a preferred embodiment of the invention will now be described in more detail with reference to FIGS. 5–7. FIG. 5 shows the second coupling part 1*b* positioned in the intermediate position, from which part 1*b* is vertically lowered down onto contact with the first coupling part 1*a*. FIG. 6 shows the coupling arrangement after the actuation of the locking device 40, i.e. after the contact housing 2*b* of the second coupling part 1*b* has been moved in relation to the contact housing 2*a* of the first coupling part 1*a* so as to secure the two contact housings 2*a*, 2*b* to each other in a fluid-tight manner. In the position shown in FIG. 6, the contact element 10 is in the previously mentioned first position, in which no electric connection between the contact member 3*a* of the first coupling part 1*a* and the contact member 3*b* of the second coupling part 1*b* is established by the contact element. FIG. 7 shows the contact element 10 positioned in the previously mentioned second position, in which the contact element is establishing electric connection between said contact members 3*a*, 3*b*.

In the following, the contact housing 2*a* of the first coupling part 1*a* will be denominated the first contact housing and the contact housing 2*b* of the second coupling part 1*b* will be denominated the second contact housing. In the same manner, the contact member 3*a* of the first coupling part 1*a* will be denominated the first contact member and the contact member 3*b* of the second coupling part 1*b* will be denominated the second contact member.

The first coupling part 1*a* is provided with an attachment 4*a* for the first power conduit 7*a* and the second coupling part 1*b* is provided with an attachment 4*b* for the second power conduit 7*b*. The contact members 3*a*, 3*b* are arranged in the respective contact housing 2*a*, 2*b* partly surrounded by a chamber 5*a*, 5*b* filled with dielectric fluid. Compensators, not shown, are suitably arranged in said chambers 5*a*, 5*b* for counter-balancing hydrostatic pressure and for taking care of volumetric compensation in connection with expansion/contraction of the dielectric fluid. The compensators preferably comprise metallic bellows, but may also be made of elastomer materials.

In the embodiment illustrated in FIGS. 5–7, the respective contact member 3*a*, 3*b* comprises three contact pins 13*a*, 13*b*. The contact element 10 here comprises three contact sleeves 11, each of which being positionable around and in electric contact with two opposed contact pins 13*a*, 13*b* of the two contact members 3*a*, 3*b*. The contact sleeves 11 are preferably integrated into one single unit, as illustrated in FIGS. 5–7. The contact element 10 is here accommodated in the second contact housing 2*b*. The contact element 10 is supported by a piston 24 displaceably mounted in a chamber 22 arranged in the second contact housing 2*b*. Said chamber 22 is preferably filled with dielectric fluid. The piston 24 is adapted to be hydraulically actuated so as to achieve the displacement of the contact element 10 between the above-mentioned first and second positions. The above-mentioned mounting tool 30 preferably comprises a device adapted to control the hydraulic pressure in said chamber 22 so as to control the displacement of the contact element 10. The chamber 22 is connected to the mounting tool 30 via hydraulic channels 54 arranged in the second coupling part 1*b* and via the hydraulic connection 50. FIG. 7 shows the contact element 10 when positioned in said second position, i.e. when establishing electric connection between the first contact member 3*a* and the second contact member 3*b*.

When the second coupling part 1*b* is positioned in the intermediate position in contact with the first coupling part 1*a*, the former is fully aligned and properly indexed relative to the centerline of part 1*a* and the pattern of male contact pins 13*a*. Upon further lowering, performed by the mounting tool, and having fully engaged part 1*b* into part 1*a*, a securing member 44 is adapted to secure the locking members 41 in the position indicated in FIG. 6 and FIG. 7. A securing member 44 is adapted to secure the locking members 41 in the position indicated in FIG. 5. The securing member 44 is displaceably arranged in the second coupling part 1*b* and the displacement thereof is hydraulically actuated by means of the mounting tool 30. The locking members 41 are pivotally mounted to the second coupling part 1*b*. When the securing member 44 is displaced downwards in relation to the second coupling part 1*b*, the locking members 41 are free to pivot so as to allow the second coupling part 1*b* and thereby the second contact housing 2*b* to move downwards into the cavity 6 of the first coupling part 1*a* until a ring-shaped metal seal 12 of one of the contact housings abuts against a corresponding sealing surface 15 of the other contact housing. In the embodiment shown, the metal seal 12 is mounted to the second contact housing 2*b* and the first contact housing 2*a* is provided with a recess 15 for receiving the metal seal. The metal seal 12 seals the space 14 between the contact housings 2*a*, 2*b* from the surrounding sea water when the contact housings 2*a*, 2*b* have been secured to each other. The contact housings 2*a*, 2*b* are secured to each other by means of the locking device 40 in that the securing member 44 is displaced upwards in relation to the second coupling part 1*b* so as to secure the locking members 41 inside a groove 42 arranged in the cavity 6.

As appears from FIG. 6, there is a gap 20 between the first contact member 3*a* and the second contact member 3*b* when the contact housings 2*a*, 2*b* have been secured to each other. This gap 20 and the other space 14 between the contact housings 2*a*, 2*b* is initially filled with sea water. The coupling arrangement 1 is provided with a flushing system for flushing sea water out of the space 14 between the contact housings 2*a*, 2*b* and filling said space 14 with dielectric fluid when the contact housings 2*a*, 2*b* have been secured to each other in a fluid-tight manner. Preferably, the above-mentioned mounting tool 30 is used for carrying out these flushing and filling operations. In this case, the mounting tool 30 comprises a flushing device included in the flushing system. The flushing system is adapted to perform replacement of the sea water with a dielectric fluid through a flushing sequence, which involves a scheme of sequential flushing of flushing fluids via the hydraulic channels 55 indicated by CA (flushing in), CB and CC (flushing out) in FIG. 5. Said flushing system is also adapted to perform conditioning of the dielectric properties or level of the dielectric fluid entrapped in space 14, i.e. in the volume between the first contact housing 2*a* and the second contact housing 2*b*. The conditioning of the dielectric properties is preferably actively controlled by measurements by means of the flushing system. The mounting tool 30 accommodates the dielectric fluid to be used for said filling. The space 14 is connected to the mounting tool 30 via hydraulic channels 55 arranged in the second coupling part 1*b* and via the hydraulic connection 50.

Preferably, the dielectric properties inside the contact housings 2*a*, 2*b* is determined by measurements performed after said filling with dielectric fluid and before said displacement of the contact element 10. The determination of the dielectric properties inside the contact housings 2*a*, 2*b* is for instance determined based on measurements of the insulation resistance between the respective electric phase and phase ground. The resulting dielectric level of said conditioning is verifiable through the insulation resistance measurements, the acceptance of the latter should be within the minimum requirements so as to establish a non-conducting environment of the space 14 in order to commence the actual mating of the contact members 3*a*, 3*b*. Hence, in this way the dielectric properties or level around the contact members 3*a*, 3*b* can be determined and recorded or documented, as compared to prior art embodiments having no means or method for providing such documentation prior to applying service voltage and current. Said measurements are preferably performed with the aid of the mounting tool 30.

After the establishment of the electric connection between the contact members 3*a*, 3*b*, the mounting tool 30 is suitably removed from the second coupling part 1*b*.

By means of the inventive coupling arrangement 1, it is also possible to disconnect the two power conduits 7*a*, 7*b* electrically from each other without any mutual separation of the contact housings 2*a*, 2*b*. This is accomplished by a simple displacement of the contact element 10 from the above-mentioned second position to the above-mentioned first position. This displacement of the contact element 10 may be suitably remotely controlled through an electro-hydraulic control arrangement connected to the second coupling part via the connection part 52. The control arrangement is connected to the second coupling part 1*b* after the removal of the mounting tool 30 therefrom.

The above-mentioned dielectric fluid is the end product of the above-mentioned flushing sequence, which typically may involve the following three fluids the one replacing the other: sea water replaced by desalinated water (fluid no. 1), to be replaced by ethanol (fluid no. 2), which finally is replaced by the dielectric oil (fluid no. 3).

A typical area of use for the present invention is a subsea installation for separation of water from crude oil, in which supplied hydraulic or electrical power is required in order to facilitate re-injection of separated water by operation of injection pumps. Electrical power must in such a case be supplied through an electrical system facilitating high voltage transfer from a surface installation to the subsea installation.

The invention is of course not in any way restricted to the preferred embodiments described above. On the contrary, many possibilities to modifications thereof will be apparent to a man with ordinary skill in the art without departing from the basic idea of the invention such as defined in the appended claims.

The invention claimed is:

1. A coupling arrangement for use in subsea electrical power distribution comprising a first coupling part, which is provided with a first contact member arranged in a first contact housing and an attachment for a first power conduit, and a second coupling part, which is provided with a second contact member arranged in a second contact housing and an attachment for a second power conduit to be connected to the first power conduit by means of the coupling arrangement, wherein the second contact housing is removably securable to the first contact housing, a gap being provided between the first contact member and the second contact member when the contact housings are secured to each other, and a contact element is displaceably arranged in the contact housing of one of the coupling parts so as to be displaceable in relation to the contact member of the associated coupling part towards the contact member of the other coupling part, when the contact housings are secured to each other, from a first position, in which no electric connection between the first contact member and the second contact member is established by the contact element, and into a second position, in which the contact element is establishing electric connection between the first contact member and the second contact member.

2. The coupling arrangement according to claim 1, wherein the second coupling part is adapted to be mounted to the first coupling part by being lowered down vertically into engagement with the first coupling part and demounted from the first coupling part by being lifted vertically out of engagement therewith.

3. The coupling arrangement according to claim 1, wherein the first contact housing has a cavity for receiving an end part of the second contact housing.

4. The coupling arrangement according to claim 1, wherein the second coupling part is positionable in an intermediate position in contact with the first coupling part by being lowered down vertically into engagement therewith, the second contact housing being movable in relation to the first contact housing when the second coupling part is positioned in said intermediate position so as to secure the second contact housing in a fluid-tight manner to the first contact housing.

5. The coupling arrangement according to claim 4, wherein the coupling arrangement comprises a mounting tool, which is removably mountable to the second coupling part, said mounting tool being adapted to actuate the movement of the second contact housing in relation to the first contact housing so as to secure the second contact housing in a fluid-tight manner to the first contact housing.

6. The coupling arrangement according to claim 1, wherein a watertight metal seal is arranged between the contact housings so as to seal the space between the contact housings from the surrounding sea water when the contact housings have been secured to each other.

7. The coupling arrangement according to claim 4, wherein the coupling arrangement is provided with a flushing system for flushing sea water out of the space between the first contact housing and the second contact housing and filling said space with dielectric fluid when the contact housings have been secured to each other in a fluid-tight manner.

8. The coupling arrangement according to claim 7, wherein the coupling arrangement comprises a mounting tool, which is removably mountable to the second coupling part, said mounting tool comprising a flushing device included in the flushing system, and in that the flushing device is adapted to actuate the flushing out of sea water and the filling with dielectric fluid.

9. The coupling arrangement according to claim 8, wherein the mounting tool accommodates the dielectric fluid to be used for said filling.

10. The coupling arrangement according to claim 1, wherein the contact element is hydraulically actuated.

11. The coupling arrangement according to claim 10, wherein the contact housing accommodating the contact element is provided with a chamber, the contact element being supported by a piston mounted in said chamber, and in that the piston is adapted to be hydraulically actuated so as to achieve said displacement of the contact element.

12. The coupling arrangement according to claim 11, wherein the chamber is filled with dielectric hydraulic fluid.

13. The coupling arrangement according to claim 7, wherein said flushing system is adapted to control the conditioning of the dielectric level in the space of the dielectric fluid between the first contact housing and the second contact housing.

14. The coupling arrangement according to claim 11, wherein the coupling arrangement comprises a mounting tool, which is removably mountable to the second coupling part, said mounting tool comprising a device adapted to control the hydraulic pressure in said chamber so as to control said displacement of the contact element.

15. The coupling arrangement according to claim 5, wherein the mounting tool is adapted to be mounted to the second coupling part by being lowered down vertically into engagement therewith and demounted from the second coupling part by being lifted vertically out of engagement therewith.

16. The coupling arrangement according to claim 1, wherein the respective contact member comprises one or several contact pins, the contact element comprising one or several contact sleeves, each contact sleeve being positionable around and in electric contact with two opposed contact pins of the two contact members.

17. A method for connecting a first power conduit to a second power conduit by means of a coupling arrangement comprising a first coupling part, which is provided with a first contact member arranged in a first contact housing and an attachment for the first power conduit, and a second coupling part, which is provided with a second contact member arranged in a second contact housing and an attachment for the second power conduit, the method comprising:

positioning the second coupling part in an intermediate position in contact with the first coupling part by lowering the second coupling part down vertically into engagement with the first coupling part, moving the second contact housing in relation to the first contact housing so as to secure the second contact housing in a fluid-tight manner to the first contact housing, and displacing a contact element arranged in the contact housing of one of the coupling parts in relation to the contact member of the associated coupling part towards the contact member of the other coupling part from a first position, in which no electric connection between the first contact member and the second contact member is established by the contact element, and into a second position, in which the contact element is establishing electric connection between the first contact member and the second contact member.

18. The method according to claim 17, wherein the movement of the second contact housing in relation to the first contact housing in order to secure the second contact housing in a fluid-tight manner to the first contact housing is performed with the aid of a mounting tool removably mounted to the second coupling part.

19. The method according to claim 18, wherein the displacement of the contact member is performed with the aid of the mounting tool.

20. The method according to claim 17, wherein the space between the first contact housing and the second contact housing is flushed free of sea water and filled with dielectric fluid after the securing of the contact housings in a fluid-tight manner to each other and before said displacement of the contact member.

21. The method according to claim 20, wherein said flushing and filling is performed with the aid of the mounting tool.

22. The method according to any of claim 20, wherein the conditioning of the dielectric level in a space of the dielectric fluid between the first contact housing and the second contact housing is controlled by measurements by means of a flushing system.

23. The method according to claim 20, wherein the dielectric level inside the contact housings is determined by measurements performed after said filling with dielectric fluid and before said displacement of the contact element.

24. The method according to claim 22, wherein said measurements are performed with the aid of the mounting tool.

25. The method according to claim 18, wherein the mounting tool is mounted to the second coupling part by being lowered down vertically into engagement with the second coupling part after the positioning of the second coupling part in the intermediate position in contact with the first coupling part.

* * * * *